US005777611A

United States Patent [19]

Song

[11] Patent Number: 5,777,611

[45] Date of Patent: Jul. 7, 1998

[54] APPARATUS FOR CONTROLLING POWER SEQUENCE OF AN LCD MODULE

[75] Inventor: Yoon Seok Song, Kyoungkido, Rep. of Korea

[73] Assignee: Hyundai Electronics Industries Co., Ltd., Kyoungkido, Rep. of Korea

[21] Appl. No.: 649,509

[22] Filed: May 17, 1996

[30] Foreign Application Priority Data

May 17, 1995 [KR] Rep. of Korea ..... 1995-12294

[51] Int. Cl.[6] ..... G09G 5/00

[52] U.S. Cl. ..... 345/212; 345/211; 345/52

[58] Field of Search ..... 345/212, 211, 345/213, 204, 87, 52; 315/160, 219, 291, 307, 226, 158; 395/750

[56] References Cited

U.S. PATENT DOCUMENTS

| | | | |
|---|---|---|---|
| 4,872,002 | 10/1989 | Stewart et al. | 345/211 |
| 5,323,171 | 6/1994 | Yokouchi et al. | 345/211 |
| 5,404,150 | 4/1995 | Murata | 345/211 |
| 5,576,601 | 11/1996 | Koenck et al. | 345/211 |

*Primary Examiner*—Dennis Doon-Chow

*Attorney, Agent, or Firm*—Jacobson, Price, Holman & Stern, PLLC

[57] ABSTRACT

The present invention relates to an apparatus for sequentially controlling power to operate an LCD module through the internal circuit of an LCD controller, and comprises a timing and comparing means for receiving a timer value and a clock signal from an external circuit and outputting a match signal to control a time interval to sequentially generate said enable signals and to sequentially disable said enable signals; a display control means for controlling said display responsive to a display control signal, a write control signal and a reset signal from said external circuit; a power sequence FSM (finite state machine) for receiving the output of said display control means, said match signal from said timing and comparing means, said clock signal from an external circuit and a FSM reset signal, and outputting a clear signal to said timing and comparing means or outputting a first and second power enable signals and a control enable signal to said display; and a FSM reset signal generating means for receiving said reset signal from said external circuit and said first and second power enable signals and said control enable signal from said power sequence FSM, and outputting said FSM reset signal to said power sequence FSM in order to mask said first and second power enable signals and said control enable signal.

21 Claims, 5 Drawing Sheets

APPARATUS FOR CONTROLLING POWER SEQUENCE OF AN LCD MODULE

BACKGROUND OF THE INVENTION

1. Field of the Invention

The present invention relates to an apparatus for sequentially controlling power supplied to an LCD module through the internal circuit of an LCD controller, and more particularly, to an apparatus capable of preventing the LCD system from damage at resetting it, by sequentially supplying power for an LCD system.

2. Description of the Prior Art

FIG. 1 is a schematic view illustrating a conventional LCD controller. As shown in FIG. 1, the first and second powers $V_{DD}$and $V_{EE}$ are supplied for an LCD module 12 under the control of a power sequence controller, the first power $V_{DD}$ of which drives an internal chip of the LCD module, the second power $V_{EE}$ of which biases liquid crystals. There are provided switching transistors 14 and 15 to control a power supply of the first and second powers $V_{DD}$ and $V_{EE}$, respectively, according to the first and second enable signals from a power sequence controller 11. Also, the power sequence controller 11 generates a control enable signal to control a control signal which is input to the LCD module through a three-state gate 13.

As shown in FIG. 2 which illustrates a timing of FIG. 1, it is noted that the first enable signal, the control enable signal and the first enable signal from the power sequence controller 11 must be sequentially supplied for the switching transistor 14, the three-state gate 13 and the switching transistor 15 at intervals of time T, respectively. In case where this sequence is created in disorder, the LCD module can not be employed because of damages of the LCD crystals. Although the time intervals $T_1$ to $T_4$ different from one another can be used according to the types of the LCD modules, it is imperative that the power sequence controller is used in the LCD system because this sequence must not be disregarded.

However, since the conventional LCD power sequence controller doesn't discriminate the difference between the reset signal generated when the LCD system is booted and the reset signal generated when the LCD system is operating, the LCD module can be damaged if hardware reset is generated when power is applied to the LCD module, by temporally removing all the power. This damages cause the LCD module not to be used.

SUMMARY OF THE INVENTION

An object of the present invention is to provide an LCD power sequence control unit capable of discriminating between the difference between the reset signal generated when the LCD system is booted and the reset signal generated when the LCD system is operating using a feed back path.

In accordance with an aspect of the present invention, there is provided an apparatus for sequentially controlling enable signals to supply power to a display, comprising:

a timing and comparing means for receiving a timer value and a clock signal from an external circuit and outputting a match signal to control a time interval to sequentially generate said enable signals and to sequentially disable said enable signals;

a display control means for controlling said display responsive to a display control signal, a write control signal and a reset signal from said external circuit;

a power sequence FSM (finite state machine) for receiving the output of said display control means, said match signal from said timing and comparing means, said clock signal from an external circuit and a FSM reset signal, and outputting a clear signal to said timing and comparing means or outputting a first and second power enable signals and a control enable signal to said display; and a FSM reset signal generating means for receiving said reset signal from said external circuit and said first and second power enable signals and said control enable signal from said power sequence FSM, and outputting said FSM reset signal to said power sequence FSM in order to mask said first and second power enable signals and said control enable signal.

BRIEF DESCRIPTION OF THE DRAWINGS

Other objects and aspects of the invention will become apparent from the following description of embodiments with reference to the accompanying drawings, in which.

DETAIL DESCRIPTION OF THE PREFERRED EMBODIMENT

Hereinafter, an embodiment of the present invention will be described below in detail referring to FIGS. 3 to 7.

Figure 1:
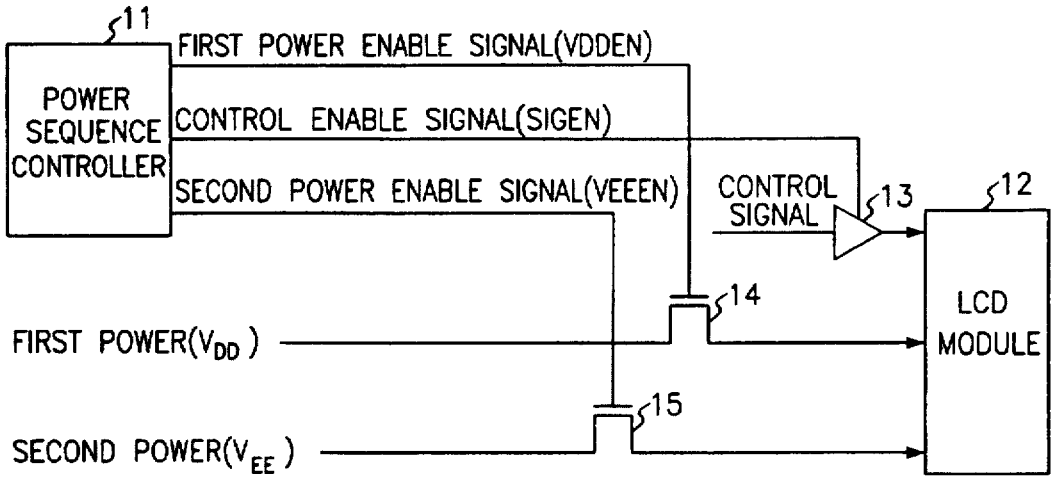
FIG. 1 PRIOR ART
FIG. 1 is a schematic view illustrating a conventional LCD controller.
Figure 2:
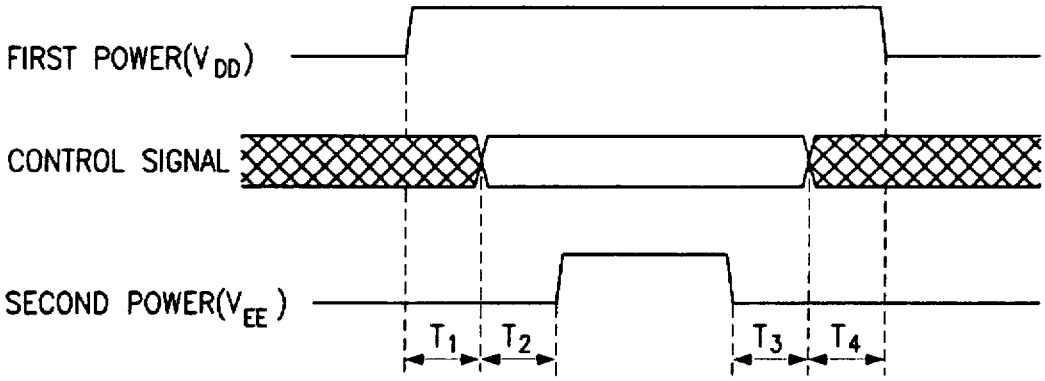
FIG. 2 PRIOR ART
FIG. 2 is a timing diagram of FIG. 1.
Figure 3:
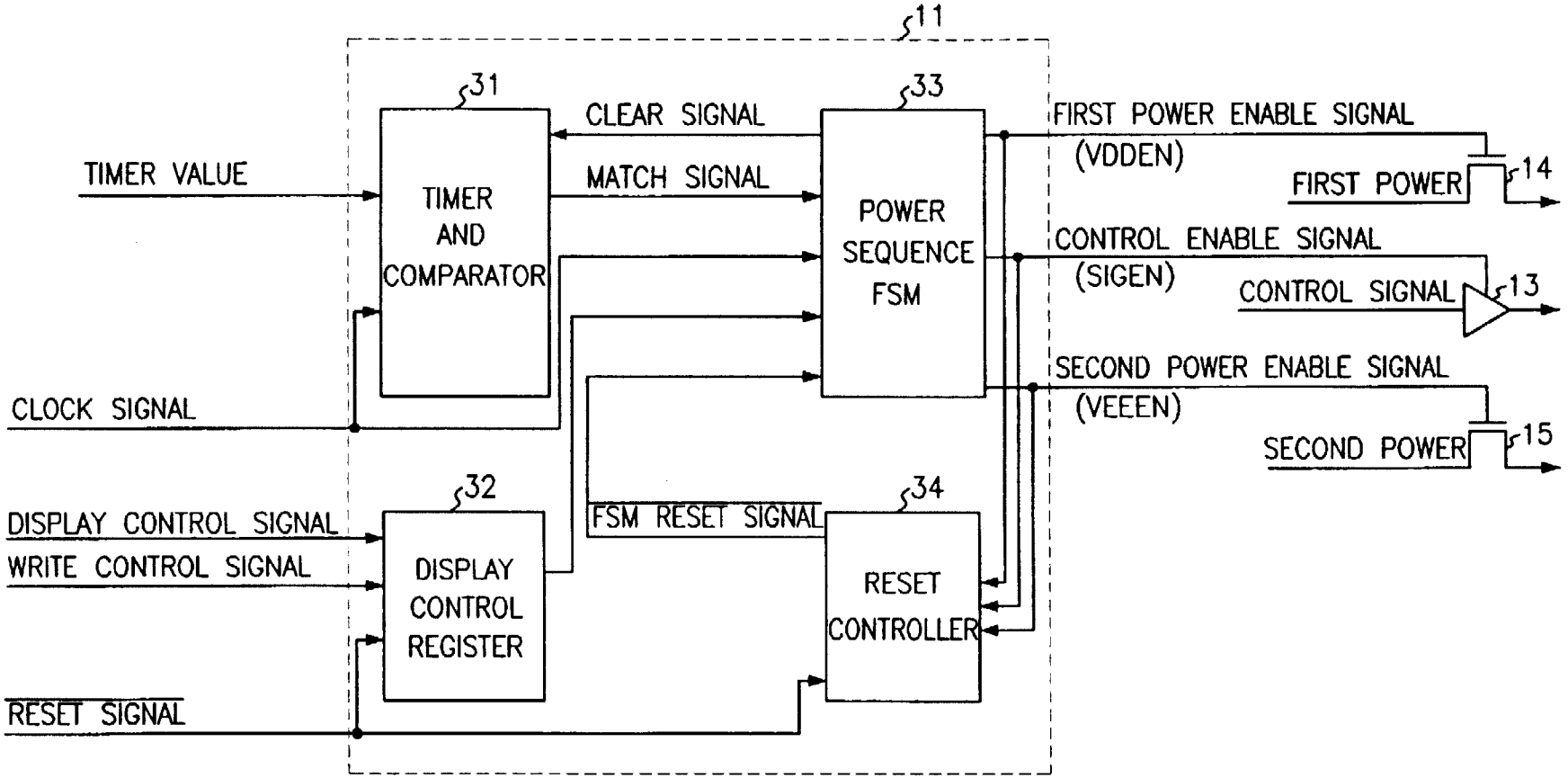
FIG. 3 is a schematic view illustrating an LCD power sequence controller in accordance with the present invention.

First, FIG. 3 is a schematic view illustrating an LCD power sequence controller in accordance with the present invention, in which the reference numeral 31, 32, 33 and 34 denote a timer and comparator, a control register, a power sequence FSM and a reset controller, respectively.

As shown in FIG. 3, input from the external circuit is a timer value corresponding to the time necessary to sequentially control the power supply, a clock signal to synchronize the internal circuit, a display control signal indicating whether an output is displayed on the LCD panel, a write signal for writing the display control signal into the register and a reset signal for initializing the system. Also, the LCD power sequence controller in accordance with the present invention outputs a first and second enable signals VDDEN and VEEEN and a control enable signal SIGEN.

The timer and comparator 31 receives from an external circuit a timer value corresponding to the time interval necessary to sequentially control the power supply and generates a match signal to control the time interval (T).

The control register 32 is initialized by the reset signal of "low" state and controls the LCD panel responsive to the display control signal and the write control signal.

The power sequence FSM 33, which takes charge of internal operations, outputs a clear signal to the timer and comparator 31, or the first and second enable signals VDDEN and VEEEN and the control enable signal SIGEN to the LCD module, according to the display control signal from the control register 32, the reset signal (low state) from the reset controller 34 and the match signal from the timer and comparator 31.

The reset controller 34 forms a feed back path together with the power sequence FSM 33, outputting a FSM reset signal of a "low" state to the power sequence FSM 33 and receiving the first and second enable signals VDDEN and VEEEN and the control enable signal SIGEN from the power sequence FSM 33.

Figure 4:
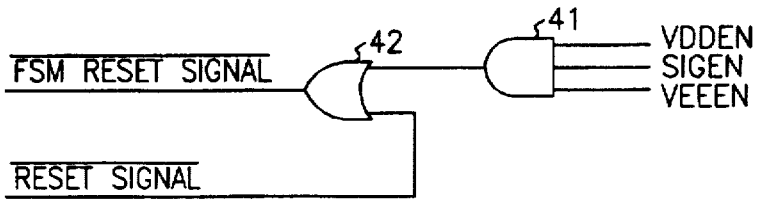
FIG. 4 is a configuration illustrating a rest controller of FIG. 3.

FIG. 4 is a configuration illustrating a rest controller of FIG. 3. AS shown in FIG. 4, the reset controller 34 consists of an AND gate 41 and an OR gate 42. The AND gate 41 receives the first and second enable signals VDDEN and VEEEN and the control enable signal SIGEN from the power sequence FSM 33 and outputs the result of the logic multiplication to the OR gate 42. The OR gate 42 receives the result of the AND gate 41 and the reset signal of "low" state and generates the FSM reset signal of the "low" state.

Figure 5:
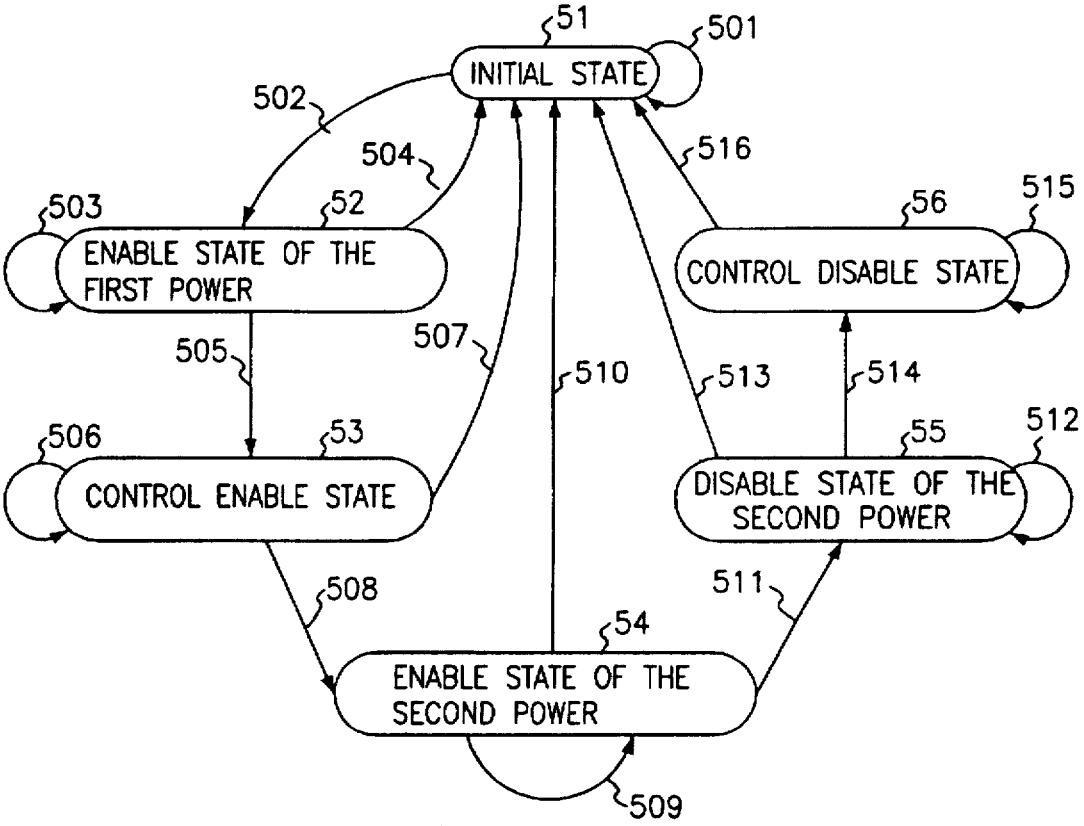
FIG. 5 is a state diagram illustrating shifts between states of a power sequence FSM (finite state machine) of FIG. 3.

FIG. 5 is a state diagram illustrating shifts between states of the power sequence FSM of FIG. 3. As shown in FIG. 5, if the FSM reset signal of the "low" state or the display control signal of the "low" state is input at the initial state, the power sequence FSM 33 outputs the clear signal and it is initialized at loop 501. Also, If the display control signal is input, the power sequence FSM 33 outputs the first power enable signal and then the enable state of the first power 52 is established at path 502.

At the enable state of the first power 52, if the match signal of the "low" state is input, the power sequence FSM 33 outputs the first power enable signal and it is again in the enable state of the first power 52 at path 503, and if the FSM reset signal of the "low" state is input, the power sequence FSM 33 outputs the clear signal and it is in the initial state at path 504. Further, if the match signal of the "high" state is input, the power sequence FSM 33 outputs the first and second power enable signals and the control enable signal at path 505.

At the control enable state 53, if the match signal of the "low" state is input, the first power enable signal VDDEN and the control enable signal SIGEN are output and it is again in the state of the control enable state 53 at path 506. Also, if the FSM reset signal of the "low" state is input, the clear signal is output and it is in the initial state 51 at path 507, and if the match signal of the "high" state is input, the first and second power enable signals VDDEN and VEEEN and the control enable signal SIGEN are output and it is again in the enable state of the second power 54 at path 508.

At the enable state of the second power 54, if the display control signal of the "high" state is input, the first and second power enable signals VDDEN and VEEEN and the control enable signal SIGEN are output and it is again in the enable state of the second power 54 at path 509. Also, if the FSM reset signal of the "low" state is input, the clear signal is output and it is in the initial state 51 at path 510, and if the display control signal of the "low" state is input, the first power enable signals VDDEN, the control enable signal SIGEN and the clear signal are output and it is again in the disable states of the second power 55 at path 511.

At the disable state of the second power 55, if the match signal of the "low" state is input, the first power enable signals VDDEN and the control enable signal SIGEN are output and it is again in the disable state of the second power 55 at path 512. Also, if the FSM reset signal of the "low" state is input, the clear signal is output and it is in the initial state 51 at path 513, and if the match signal of the "high" state is input, the first power enable signals VDDEN and the clear signal are output and it is again in the control disable state 56 at path 514.

At the control disable state 56, if the match signal of the "low" state is input, the first power enable signal is output and it is again in the state of the control disable state 56 at path 515. Also, if the FSM reset signal of the "low" state or the match signal of the "high" state is input, the clear signal is output and it is in the initial state 51 at path 516.

Figure 6:
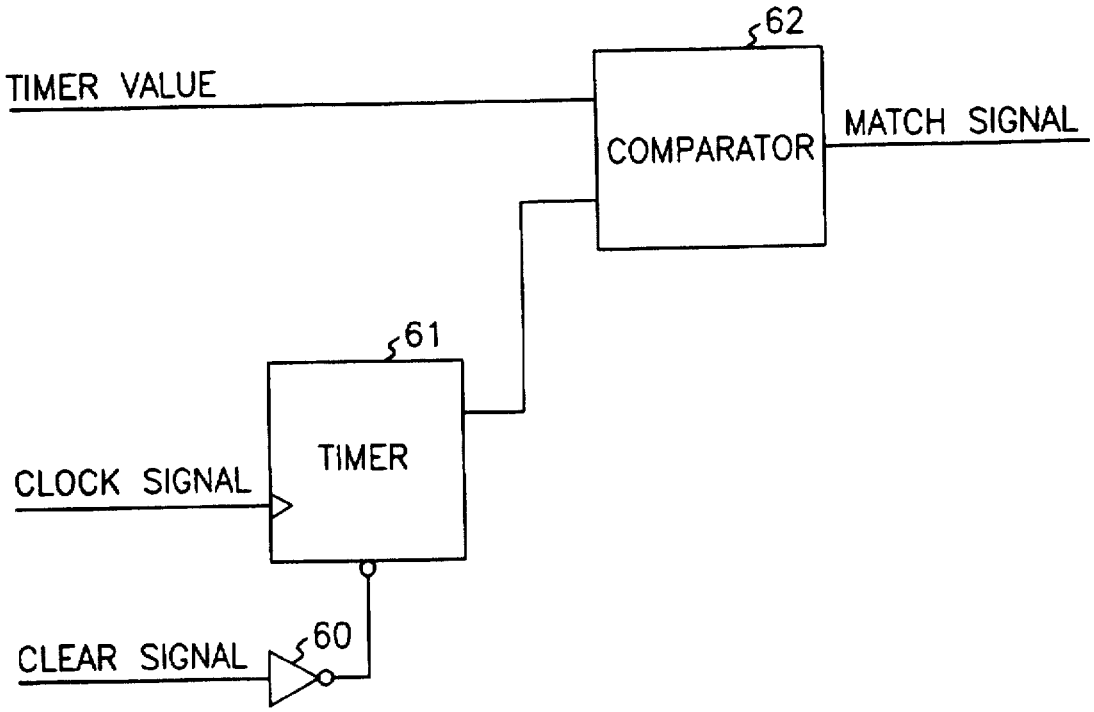
FIG. 6 is a diagram illustrating a timer and comparator of FIG. 3.

FIG. 6 is a diagram illustrating the timer and comparator 31 of FIG. 3. As shown in FIG. 6, the timer and comparator 31 consists of a timer 61 and a comparator 62. The timer 61 is cleared responsive to the output of an inverter 60 which receives the clear signal and it is clocked responsive to the clock signal from the external circuit. The comparator 62 which receives the timer value from the external circuit and the output of the timer 61 and then outputs the match signal.

When the state of the power sequence FSM 33 is changed, the time which is desired to the sequence to turn on/off the display starts counting. The match signal is output from the comparator 62 if the counted time is the same as the predetermined time by the time value such that the state of the power sequence FSM 33 is changed into other states, and the timer 61 re-starts in a cleared state.

Figure 7:
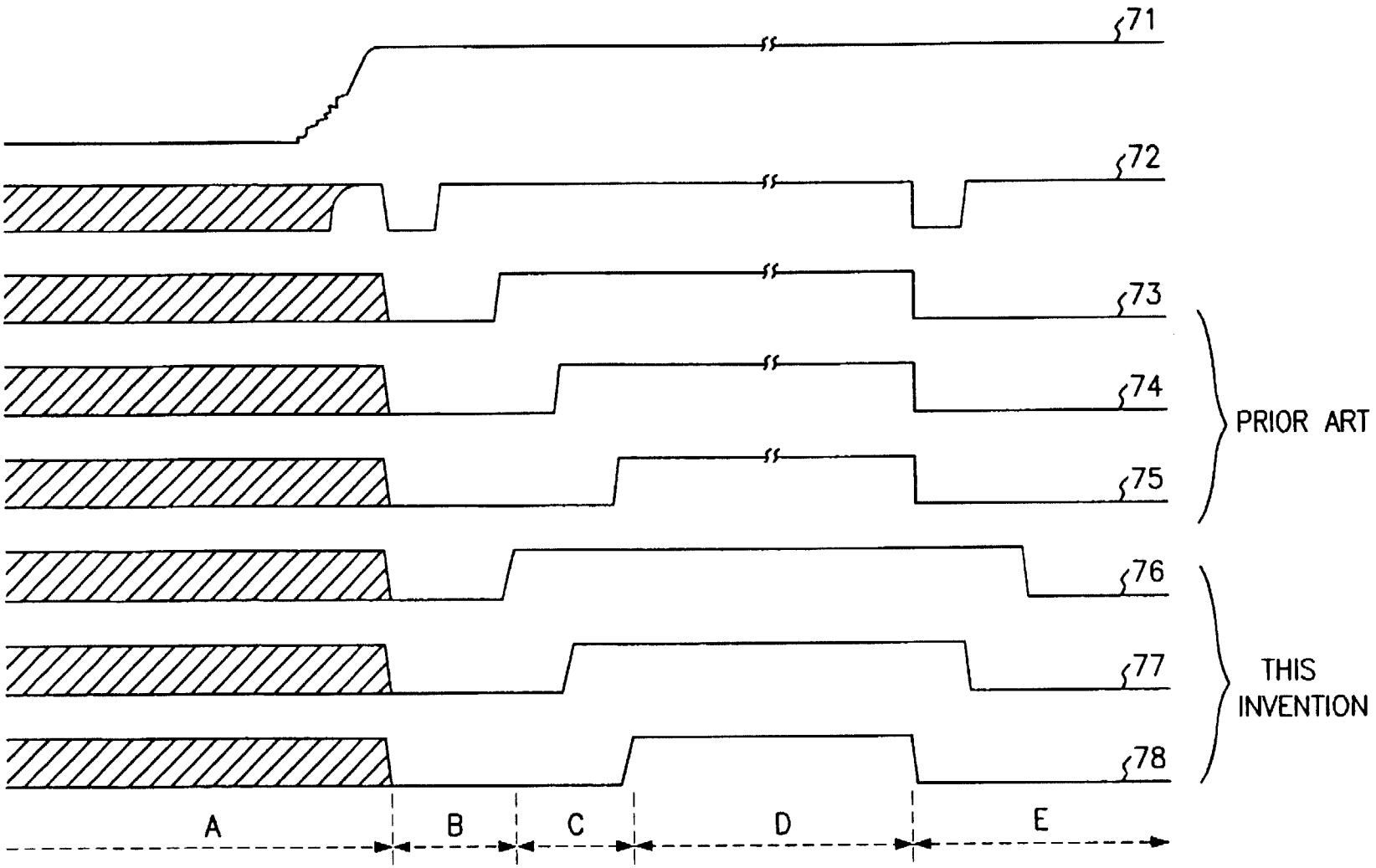
FIG. 7 is a timing diagram of the controller according to the present invention shown in FIG. 3 together with the conventional LCD controller.

FIG. 7 is a timing diagram of the controller according to the present invention shown in FIG. 3 together with the conventional LCD controller. In FIG. 7, the reference numerals 71 denotes the first power of +5 V, 72 denotes a reset signal, 73 denotes the first power enable signal according to the prior art, 74 denotes the control enable signal according to the prior art, 75 denotes the second power enable signal according to the prior art, 76 denotes the first power enable signal according to the present invention, 77 denotes the control enable signal according to the present invention and 78 denotes the second power enable signal according to the present invention.

As shown in FIG. 7, section A indicates the time between the system booting and before the reset signal is input. At this time, because all the internal circuits are not initialized, it is not known whether any other signals are produced.

Section B indicates the reset by the system booting. In section B, the power must not be applied to the LCD module because data to be transferred to the LCD module and the control signal are not produced yet. Accordingly, all the enable signal must be enabled, and also, the FSM reset signal must be enabled in order that the power sequence FSM 33 is in the initial state. As shown in FIG. 4, the FSM reset signal is produced by the first and second enable signals VDDEN and VEEEN and the control signal SIGEN. Since it is not known what value these signals have, the power sequence FSM can not be initialized in the probability on the scale of 1:8. However, because the display control register 32 is cleared in the "off" state, it can be in the initial state.

In section C, the power sequence FSM 33 transfers to the second enable state through the first power enable state and the control enable state, by writing the value of 1 to the display control register 32 and it supplies powers to the LCD module in order, as shown in FIG. 5.

In section D, the power sequence FSM 33 waits for the display control signal to be the second power enable state as a "low" state, the LCD module displays pictures.

Section E shows the operation of the LCD controller when the power is applied to the LCD controller, and then, the reset signal is input to it. As shown in FIG. 7, in the conventional LCD, the first and second power enable signals 73 and 75 and the control enable signal 74 is disabled in disorder irrespective of the priority. However, in the present invention, the first and second power enable signals 76 and 78 and the control enable signal 77 is disabled in order by the feed back path. That is, since the power sequence FSM is in the initial state through the second power disable state and the control disable state, the LCD module is not damaged by the reset signal applied to the LCD controller when the power is on.

As stated above, the present invention has an effect that the LCD module is prevented from being damaged by the reset signal, by sequentially controlling the enable signal applied to the LCD module.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for sequentially controlling enable signals to supply power to a display, comprising:

a timing and comparing means for receiving a timer value and a clock signal from an external circuit and outputting a match signal to control a time interval to sequentially generate said enable signals and to sequentially disable said enable signals;

a display control means for controlling said display responsive to a display control signal, a write control signal and a reset signal from said external circuit;

a power sequence FSM (finite state machine) for receiving the output of said display control means, said match signal from said timing and comparing means, said clock signal from an external circuit and a FSM reset signal, and outputting a clear signal to said timing and comparing means or outputting a first and second power enable signals and a control enable signal to said display; and a FSM reset signal generating means for receiving said reset signal from said external circuit and said first and second power enable signals and said control enable signal from said power sequence FSM, and outputting said FSM reset signal to said power sequence FSM in order to mask said first and second power enable signals and said control enable signal.

2. An apparatus in accordance with claim 1, wherein said timing and comparing means comprises:

an inverting means for inverting said clear signal from said power sequence FSM;

a timer for receiving said clock signal from said external circuit and the output of the said inverting means; and a comparator for outputtig said match signal to said power sequence FSM, comparing said time interval with the output of said timer.

3. An apparatus in accordance with claim 1, wherein said FSM reset signal generating means comprises:

a logically multiplying means for multiplying said first and second power enable signals by said control enable signal; and a logically adding means for adding the output of said logically multiplying means to said reset signal from said external circuit.

4. An apparatus in accordance with claim 1, wherein said power sequence FSM is initialized by said FSM reset signal from said FSM reset signal generating means.

5. An apparatus in accordance with claim 1, wherein said power sequence FSM is in one of an initial state, a first power enable state, a control enable state, a second power enable state, a disable state of the second power and a control disable state under the control of said FSM reset signal, said display control signal and said match signal.

6. An apparatus in accordance with claim 5, wherein said power sequence FSM outputs said clear signal when said FSM reset signal of "low" state or said display control signal of "low" state is input in said initial state, and transfers to said initial state again.

7. An apparatus in accordance with claim 5, wherein said power sequence FSM outputs said first power enable signal when said display control signal of "high" state is input in said initial state, and transfers to said first power enable state.

8. An apparatus in accordance with claim 5, wherein said power sequence FSM outputs said first power enable signal when said match signal of "low" state is input in said first power enable state, and transfers to said first power enable state again.

9. An apparatus in accordance with claim 5, wherein said power sequence FSM outputs said clear signal when said FSM reset signal of "low" state is input in said first power enable state, and transfers to said initial state.

10. An apparatus in accordance with claim 5, wherein said power sequence FSM outputs said first power enable signal, said control enable signal and said clear signal when said match signal of "high" state is input in said first power enable state, and transfers to said control enable state.

11. An apparatus in accordance with claim 5, wherein said power sequence FSM outputs said first power enable signal and said control enable signal when said match signal of "low" state is input in said control enable state, and transfers to said control enable state again.

12. An apparatus in accordance with claim 5, wherein said power sequence FSM outputs said clear signal when said FSM reset signal of "low" state is input in said control enable state, and transfers to said initial state.

13. An apparatus in accordance with claim 5, wherein said power sequence FSM outputs said first and second power enable signals, said control enable signal when said match signal of "high" state is input in said control enable state, and transfers to said second power enable state.

14. An apparatus in accordance with claim 5, wherein said power sequence FSM outputs said first and second power enable signals, and said control enable signal when said display control signal of "high" state is input in said second power enable state, and transfers to said second power enable state again.

15. An apparatus in accordance with claim 5, wherein said power sequence FSM outputs said clear signal when said FSM reset signal of "low" state is input in said second power enable state, and transfers to said initial state.

16. An apparatus in accordance with claim 5, wherein said power sequence FSM outputs said first power enable signal, said control enable signal and said clear signal when said display control signal of "low" state is input in said second power enable state, and transfers to said disable state of the second power.

17. An apparatus in accordance with claim 5, wherein said power sequence FSM outputs said first power enable signal and said control enable signal when said match signal of "low" state is input in said disable state of the second power, and transfers to said disable state of the second power again.

18. An apparatus in accordance with claim 5, wherein said power sequence FSM outputs said clear signal when said FSM reset signal of "low" state is input in said disable state of the second power, and transfers to said initial state.

19. An apparatus in accordance with claim 5, wherein said power sequence FSM outputs said first power enable signal and said clear signal when said match signal of "high" state is input in said disable state of the second power, and transfers to said control disable state.

20. An apparatus in accordance with claim 5, wherein said power sequence FSM outputs said first power enable signal when said match signal of "low" state is input in said control disable state, and transfers to said control disable state again.

21. An apparatus in accordance with claim 5, wherein said power sequence FSM outputs said clear signal when said match signal of "high" state or said FSM reset signal of "low" state is input in said control disable state, and transfers to said initial state.

* * * * *